US008439700B2

(12) United States Patent
Hachuda

(10) Patent No.: US 8,439,700 B2
(45) Date of Patent: May 14, 2013

(54) SOCKET FOR ELECTRICAL PARTS

(75) Inventor: Osamu Hachuda, Saitama (JP)

(73) Assignee: Enplas Corporation, Saitama (JP)

( * ) Notice: Subject to any disclaimer, the term of this patent is extended or adjusted under 35 U.S.C. 154(b) by 0 days.

(21) Appl. No.: 13/298,436

(22) Filed: Nov. 17, 2011

(65) Prior Publication Data

US 2012/0135627 A1 May 31, 2012

(30) Foreign Application Priority Data

Nov. 30, 2010 (JP) ..... 2010-266289

(51) Int. Cl.
*H01R 13/64* (2006.01)

(52) U.S. Cl.
USPC ..... 439/381

(58) Field of Classification Search ..... 439/381
See application file for complete search history.

(56) References Cited

U.S. PATENT DOCUMENTS 6,171,133 B1 * 1/2001 Altuner et al. ..... 439/381
6,203,356 B1 * 3/2001 Thomsen ..... 439/381

FOREIGN PATENT DOCUMENTS

JP 3-155082 7/1991

* cited by examiner

*Primary Examiner* — Gary F. Paumen
(74) *Attorney, Agent, or Firm* — Staas & Halsey LLP

(57) ABSTRACT

A socket for electrical parts which makes a locater plate fulfill the function satisfactory and enhance the operational feeling of the locater plate. In a preferred embodiment of the present invention, the lock members are fixed on the vertically movable locater plate. The top of the lock member is the first engaging potion formed so as to have a hook shape, and the bent double portion thereof is a second engaging portion. The first engaging portion regulates the downward movement of the locater plate at the bottom position. The second engaging portion which regulates the upward movement and releases the regulation of the upward movement by deforming elastically when a force larger than a predetermined value is applied.

10 Claims, 6 Drawing Sheets

SOCKET FOR ELECTRICAL PARTS

BACKGROUND OF THE INVENTION

1. Field of the Invention

The present invention relates to a socket for electrical parts which is located on a wiring substrate and accommodates an electrical part such as a semiconductor device (hereinafter, called an "IC package") for executing a test of the electrical part.

2. Description of the Prior Art

Conventionally, the IC socket, which accommodates an IC package as "electrical part" removably, is known as the above-mentioned "socket for electrical part".

The IC socket comprises a socket body which is mounted on the wiring substrate. The socket body comprises plural contact pins which electrically connect the IC package terminals and the wiring substrate. Moreover, the locater plate, which guards the lower terminal portions of the contact pins, is fitted on the lower side of the socket body. By the locater plate, the lower terminal portions of the contact pins are prevented from being bent while the IC socket is carried (see Japanese laid-open patent publication H3-155082).

The locater plate comprises plural ungues. On the other hand, the socket body comprises the projections. The locater plate can repetitively switch the position of itself between the top position and the bottom position (that is, the position lower than the socket body and near the lower terminal portion) based on the engaging state of the ungues and the projections. Consequently, the locater plate is held at the bottom position when the IC socket is not yet mounted on the wiring substrate (for example, while the IC socket is carried). On the other hand, when the locater plate is mounted onto the wiring substrate, the wiring substrate pushes up the locater plate and so the locater plate rises to the uppermost position.

However, in the case of conventional IC socket, the force for keeping the locater plate at the bottom-most position is not so strong when the IC socket is not yet mounted on the wiring substrate, because the ungues of the locater plate only engages with the socket body. Therefore, the locater plate is easy to rise toward the side of the socket body due to the oscillation of the IC socket and so forth, while the IC socket is carried. As a result, there is a case where the function of the locater plate (that is, the function to keep the lower terminal portions of the contact pins at the predetermined position) cannot be fulfilled sufficiently.

In addition, the conventional IC socket has a problem that the vertical motion of the locater plate cannot be executed smoothly, and so the operational feeling of the locater plate is not good. That happens because the conventional IC socket employs the structure of which the socket body is only engaged with the ungues of the locater plate.

SUMMARY OF THE INVENTION

An object of the present invention is to provide a socket for electrical parts in which the function of the locater plate can be fulfilled sufficiently and the operational feeling of the locater plate can be enhanced.

To achieve the object, the socket for electrical parts according to the present invention comprises a socket body which accommodates an electrical part; a contact pin which is provided at the socket body and upper end portion thereof contacts to a terminal of the electrical part; a locater plate which is located on the lower side of the socket body to be vertically movable, and has an insertion hole into which the lower terminal portion of the contact pin is inserted; and a lock member which is provided at the locater plate; wherein the lock member comprises a first engaging portion which regulates the downward movement of the locater plate when the locater plate is located at the bottom-most position, and the second engaging portion which regulates the upward movement and releases the regulation of the upward movement by deforming elastically when a force larger than a predetermined value is applied.

In the present invention, it is preferable that the socket body comprises a contact pin plate; and the contact pin plate comprises a pressure hole into which the contact pin is pressed, and an engaging hole into which the lock member is inserted and in which the first and second engaging portions of the lock member are engaged with the engaging hole and released from engagement with the engaging hole.

In the present invention, it is preferable that a fixing portion which is fixed to the locater plate; and plural engaging pieces, each of which comprises first and second engaging portions extended upward from the fixing portion, and each of which is formed so as to be able to deform elastically.

In the present invention, it is preferable that the first engaging portion projects outward from a top portion of the engaging pieces so as to be engaged with the upper side outer peripheral edge portion of the engaging holes.

In the present invention, it is preferable that the first engaging portion wherein the first engaging portion is a hook shaped projection being formed so that a lower side surface of the first engaging portion contacts to an upper side outer peripheral edge portion of the engaging hole.

In the present invention, it is preferable that the second engaging portion projects outward from a central portion of the engaging pieces so as to be engaged with a lower side outer peripheral edge portion of the engaging holes.

In the present invention, it is preferable that second engaging portion is formed so as to have a shape of bent double.

In the present invention, it is preferable that the engaging piece is constructed so that; an upward movement of the lock member is regulated by making an outermost portion of the second engaging portion contact to the lower side outer peripheral edge of the engaging holes, and the engaging piece deforms elastically toward the inner side to release the regulation against the upward movement of the lock member when a force larger than a predetermined value is applied to the engaging piece.

In the present invention, it is preferable that a pair of the engaging pieces is provided symmetrically.

In the present invention, it is preferable that the lock members are disposed at plural places.

According to the present invention, the first and second engaging portions of the lock member make the position keeping force of the locater plate at the bottom position increase. Therefore, when the IC socket is carried, the oscillation of the IC socket does not cause a situation that the locater plate easily rises toward the side of the socket body. As a result, the present embodiment can sufficiently fulfil the function of the locater plate.

Moreover, the second engaging portion regulates the upward movement at the bottom-most position and releases the regulation of the upward movement by deforming elastically when a force stronger than a predetermined value is applied. Therefore, by making the elastic force work when the locater plate rises, the movement of the locater plate can become smooth and so the operational feeling of the locater plate can be enhanced.

In the case the first engaging portion is formed so as to have a hook shaped projection and the second engaging portion is formed by an engaging piece of a bent-double shape, the lock member of simple structure and inexpensive price can be supplied.

In the case a pair of the engaging pieces is provided symmetrically, the balances of movement of the lock member become good, and so the vertical movement of the locater plate can become smooth.

In the case the lock members are provided at plural places, it becomes easier to keep the horizontal state of the locator plate when vertically moving compared to the conventional IC socket in which the socket body is only engaged with the ungues of the locater plate.

Moreover, the lock member can be placed without constraints except for the region where the contact pins are located, and so it becomes possible to adjust the operation feeling and the horizontal state of the locater plate when moving vertically thereof to the excellent condition.

BRIEF DESCRIPTION OF THE DRAWINGS

Other objects and purposes of the present invention are described with referencing the following attached drawings.

DETAILED DESCRIPTION

A preferred embodiment according to the present invention is described hereinafter.

FIGS. 1 to 6 show the embodiment according to the present invention.

Figure 1:
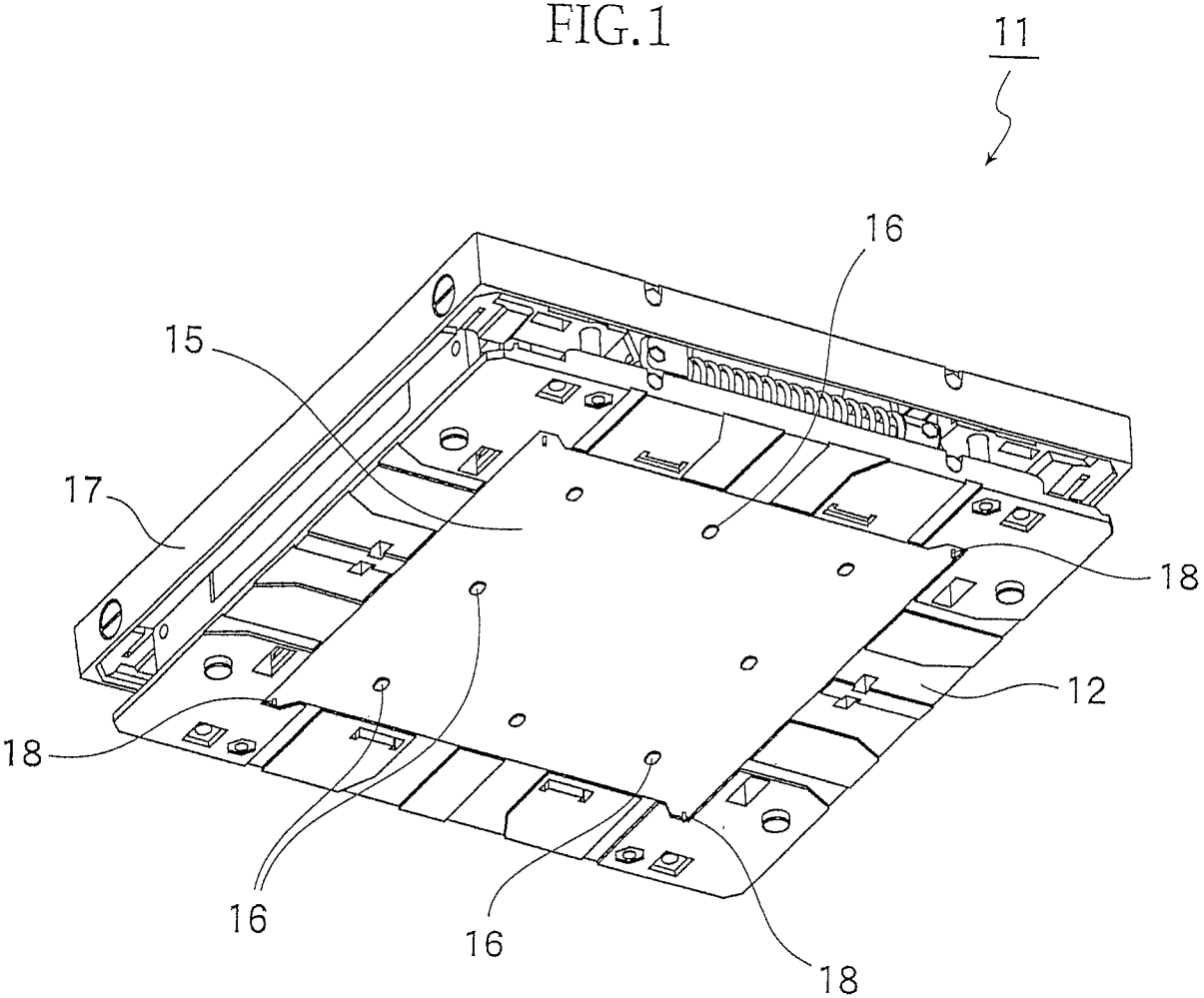
FIG. 1 is a perspective view showing the IC socket according to an embodiment of the present invention seen from obliquely below.

Firstly the constitution of the present embodiment is described. In FIG. 1, the symbol 11 corresponds to the IC socket as "socket for electrical parts". The IC socket 11 electrically connects the IC package as "electrical parts" (not shown in figures) to the wiring substrate for performing the burn-in test etc. of the IC package.

Figure 4:
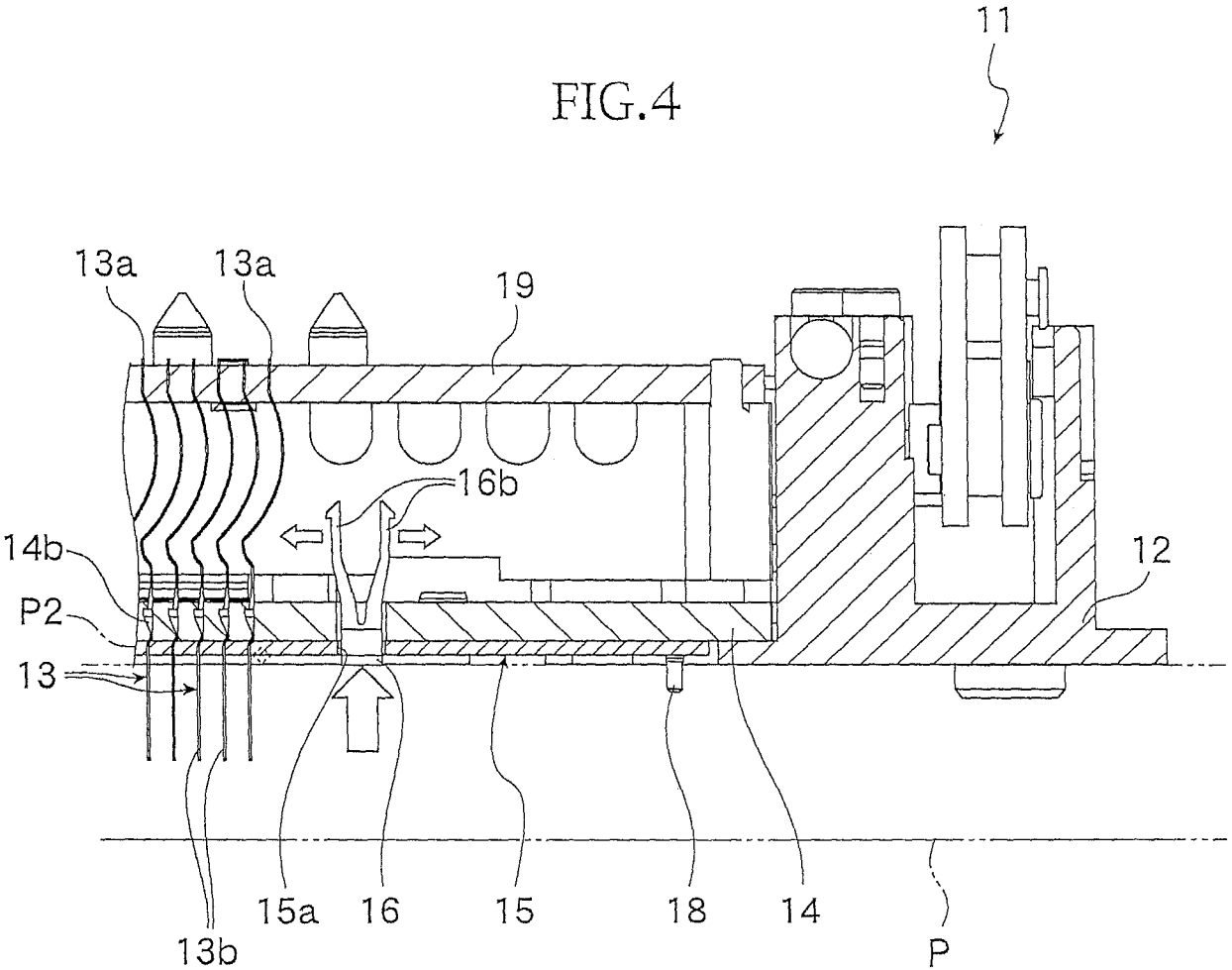
FIG. 4 is a sectional view showing the IC socket according to the same embodiment after mounting onto the wiring substrate.

As shown in FIG. 4, the IC socket 11 is constituted so as to be located on the wiring substrate P. As shown in FIG. 1, the IC socket 11 comprises a socket body 12 which is fixed on the wiring substrate P and accommodates the IC package not shown in Figures. Moreover, the IC socket 11 comprises a cover member 17 which is provided at the socket body 12 so as to be openable and closable, and used for pressing the IC package not shown in Figures. Plural contact pins 13 are inserted into the socket body 12, and the upper terminal portions 13*a* of the contact pins 13 contact to the terminals (not shown in Figures) of the IC package.

Figure 2:
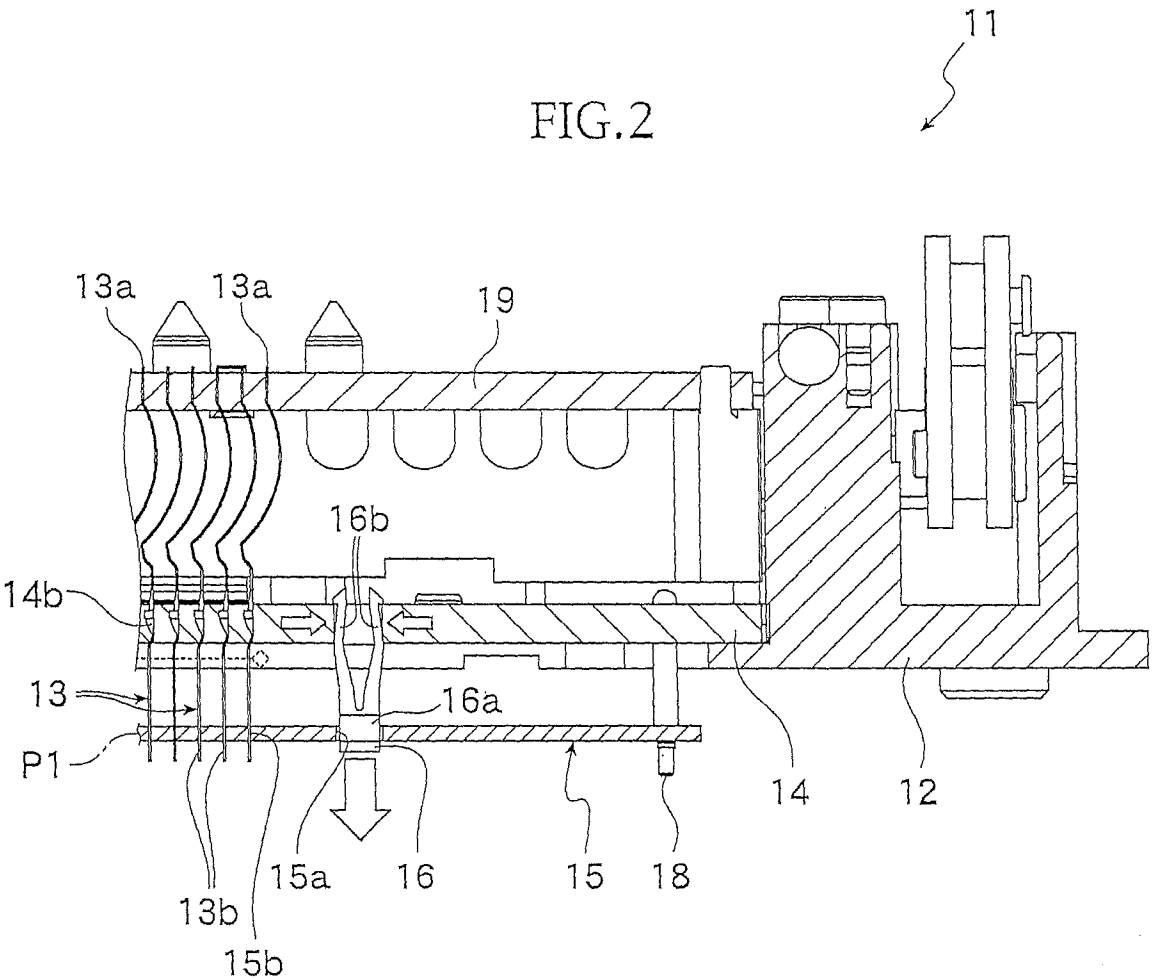
FIG. 2 is a sectional view showing the IC socket according to the same embodiment before mounting onto a wiring substrate.
Figure 6:
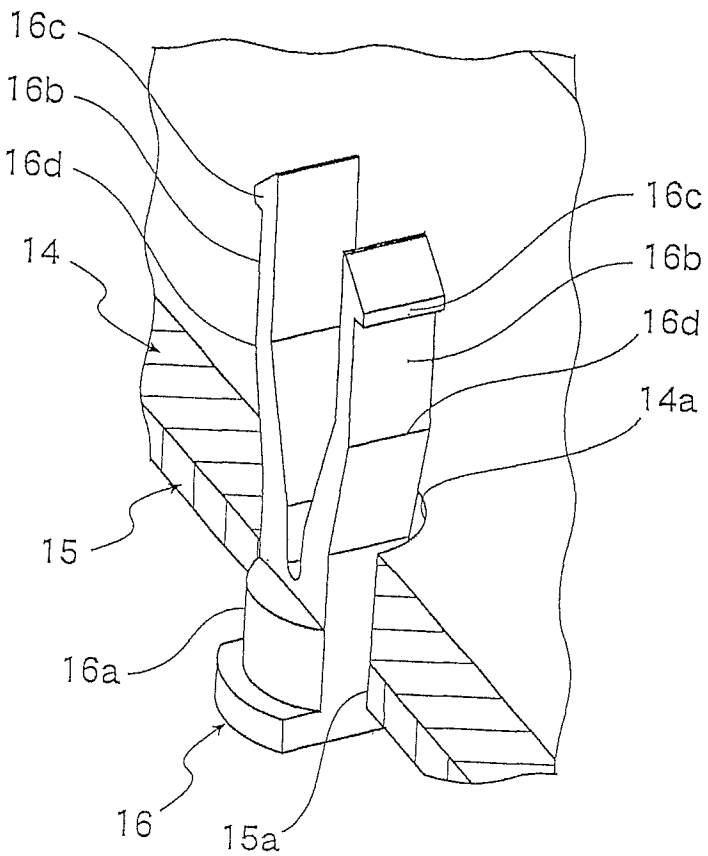
FIG. 6 is a perspective view showing the stand-off according to the same embodiment seen from obliquely above.

As shown in FIG. 2, the floating plate 19 is located on the upper portion of the socket body 12, and the contact pin plate 14 is located on the lower portion of the socket body 12. The contact pins 13 are pressed into the pressure hole 14*b* of the contact pin plate 14, and the upper terminal portions 13*a* of the contact pins 13 are inserted into the floating plate 19. As shown in FIG. 6, the contact pin plate 14 comprises the round engaging holes 14*a*.

As shown in FIGS. 1, 2 and 4, the locater plate 15, which has a flat plate form, is vertically movably mounted on the lower side of the contact pin plate 14 via four guide pins 18. The locater plate 15 comprises the insertion holes 15*b*, into which the lower terminal portions 13*b* of the contact pins 13 are inserted.

Figure 3:
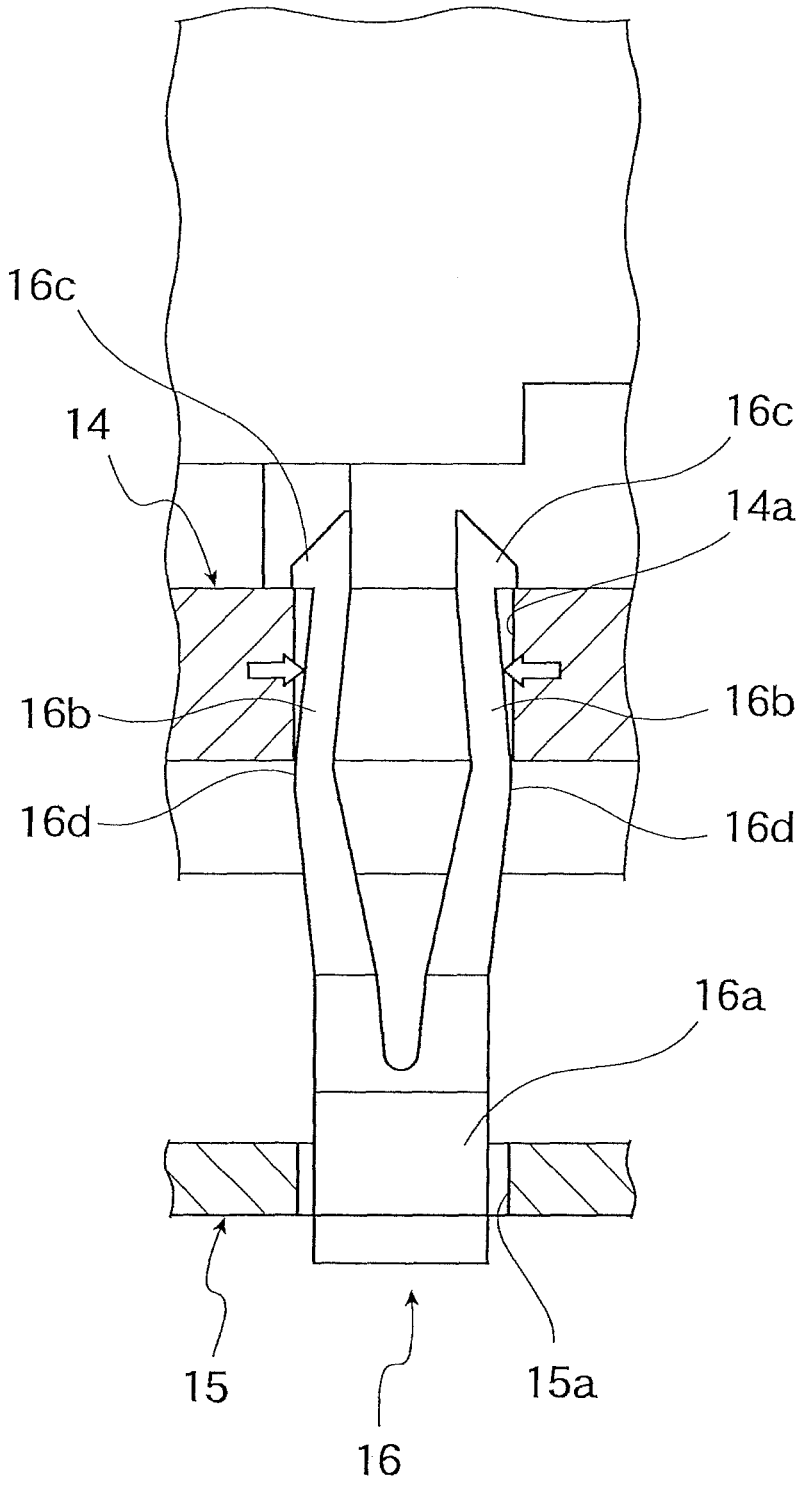
FIG. 3 is an enlarged sectional view showing a main section according to the same embodiment shown in FIG. 2.
Figure 5:
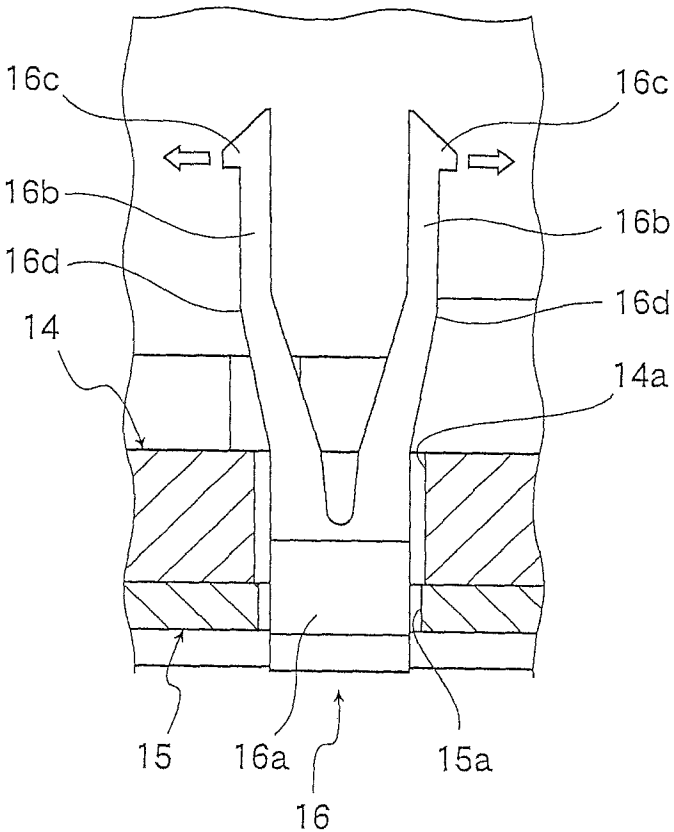
FIG. 5 is an enlarged sectional view showing a main section according to the same embodiment shown in FIG. 4.

As shown in FIG. 1, eight stand-off 16 as "lock member" are provided at even intervals at the locater plate 15. As shown in FIGS. 3 and 5, each of the stand-off 16 comprises the fixing portion 16*a* which is fixed by being pressed into the insertion hole 15*a* of the locater plate and a pair of the engaging pieces 16*b* which are symmetrically extended upward from the fixing portion 16*a*, have shapes of approximately bent double and can deform elastically. Each of the engaging pieces 16*b* comprises the first engaging portion 16*c* which regulates the downward movement of the locater plate 15 when the locater plate 15 is located at the bottom position P1, and the second engaging portion 16*d* which regulates the upward movement and releases the regulation of the upward movement by deforming elastically when a force larger than a predetermined value is applied. The first and second engaging portions 16*c* and 16*d* are constructed so as to be engaged with the engaging hole 14*a* of the contact pin plate 14 and to be released from the engaging hole 14*a*.

The first engaging portion 16*c* has a shape of a hook which projects outward, and the second engaging portion 16*d* is a bent region having a shape of bent double.

Then, a method of using the IC socket 11 is described with referencing FIGS. 2 to 5.

When the IC socket 11 is not yet mounted on the wiring substrate (for example, while the IC socket is carried), as shown in FIGS. 2 and 3, the downward movement of the engaging pieces 16*b* of plural stand-offs 16 are regulated because the first engaging portions 16*c* are engaged with the upper ends of the engaging holes 14*a* of the contact pin plate 14. Additionally, the upward movement of the engaging pieces 16*b* of plural stand-offs 16 are regulated because the second engaging portions 16*d* (that is, the bent regions of the engaging pieces 16*b*) are located at the positions lower than the lower ends of the engaging holes 14*a* and the engaging pieces 16*b* are deformed elastically toward the inner side, and so the second engaging portions 16*d* is engaged with the engaging holes 14*a* of the contact pin plate 14 by the reaction forces of the second engaging portions 16*d* working toward the outer side. Consequently, the locater plate 15 is kept at the bottom position Plunder the state not easy to move vertically. Therefore, while the IC socket 11 is carried, the oscillation of the IC socket 11 does not cause the locater plate 15 to easily move upward toward the side of the contact pin plate 14. As a result, the present embodiment can sufficiently fulfill the function of the locater plate 15 (that is, the function to keep the lower terminal portions 13*b* of the contact pins 13 at the predetermined positions).

When the IC socket 11 is located onto the wiring substrate P, as shown in FIGS. 4 and 5, the locater plate 15 is pressed up by the wiring substrate P and rises to the uppermost position P2. At this point, the lower terminal portions 13*b* of plural contact pins 13 arranged by the locater plate 15 are surely inserted into the insertion holes, which are not shown in Figures, of the wiring substrate P, and are soldered to the wiring substrate.

Under such state, if the locater plate 15 is pressed upward relatively from the state shown in FIG. 3 by the prescribed force, the engaging pieces 16*b* are deformed toward the inner side, the second engaging portions 16*d* rises and then, is released from the engaging state with the lower ends of the engaging holes 14*a*. Consequently, the second engaging portions 16*d* become capable of moving upward and the second engaging portions 16*d* rises with sliding on the internal surfaces of the engaging holes 14*a*. Next, the second engaging portions 16*d* pass through the upper side of the engaging holes 14*a*, then, the inclined surfaces of the second engaging portions 16*d* rises with sliding on the upper edges of the engaging holes 14*a*. The locater plate 15 can move upward without trembling, because the second engaging portions 16*d* rises with sliding on the internal surfaces of the engaging holes 14*a* and the inclined surfaces of the lower side of the second engaging portions 16*d* rises with sliding on the upper edges of the engaging holes 14*a* under the state that the elastic forces are acting. As a result, the movement of the locater plate 15 can become smooth, and so the operational feeling of the locater plate 15 can be enhanced.

Moreover, the locater plate 15 can move upward while keeping the horizontal state, because plural stand-offs 16 (that is, eight stand-offs 16 in the present embodiment) are arranged at even intervals on the locater plate 15.

In addition, the vertical motion of the locater plate can be executed smoothly, because two engaging pieces 16*b* of the stand-offs 16 are provided symmetrically and so the stand-offs 16 will have good balance during movement thereof.

Incidentally, the above-mentioned embodiment employs the IC socket 11 as "socket for electrical parts", however, it is clear that other kinds of electrical parts can be employed.

The above-mentioned embodiment is provided with the contact pin plate 14 at the under portion of the socket body 12, however, the contact pin plate 14 can be omitted by forming engaging holes corresponding to the engaging holes 14*a* at the socket body 12.

The locater plate 15 of the above-mentioned embodiment comprises eight stand-offs 16, however, the number of the stand-offs is arbitrary.

The stand-offs 16 of the above-mentioned embodiment comprises a pair of the engaging pieces 16*b*, however, it is possible to employ a stand-offs comprising one engaging piece or a stand-offs comprising three or more engaging pieces.

In the above-mentioned embodiment, the stand-offs are employed as "lock member", however, other construction can be employed.

Additionally, the present invention can be applied to the IC socket called the "open top type" or the "clam shell type", moreover, can be applied to the test apparatus in which the pusher for pushing the electrical part is located at the side of the automated instrument.

What is claimed is:

1. A socket comprising:

a socket body which accommodates an electrical part, a contact pin which is provided at the socket body and contacts to a terminal of the electrical part when the electrical part is accommodated by the socket body, a locater plate which is located on a lower side of the socket body to be vertically movable, and has an insertion hole into which a lower terminal portion of the contact pin is inserted, and a lock member comprising:

a fixing portion which is fixed by the locater plate, and an engaging piece which extends upward from the fixing portion and which comprises a first engaging portion formed at an upper end of the engaging piece and a second engaging portion which is elastically deformable and is formed at a lower position than the first engaging portion, the socket body comprises an engaging hole into which the engaging piece of the lock member is inserted, the first engaging portion of the lock member is engaged with the engaging hole and thereby regulates a downward movement of the locater plate when the locater plate is at a bottom position, the second engaging portion of the lock member is engaged with the engaging hole by an elastic force of the engaging piece and thereby regulates an upward movement of the locater plate when the locater plate is at the bottom position, and releases the regulation of the upward movement when a force larger than a prescribed force is applied to the locater plate.

2. The socket according to claim 1, wherein:

the socket body comprises a contact pin plate through which the engaging hole is formed, and the contact pin plate comprises a pressure hole into which the contact pin is pressed.

3. The socket according to claim 1, wherein the first engaging portion projects outward from a top portion of the engaging piece so as to be engaged with an upper side outer peripheral edge of the engaging hole.

4. The socket according to claim 1, wherein the first engaging portion is a hook shaped projection being formed so that a lower side surface of the first engaging portion contacts to an upper side outer peripheral edge of the engaging hole.

5. The socket according to claim 1, wherein the second engaging portion projects outward from a central portion of the engaging piece so as to be engaged with a lower side outer peripheral edge of the engaging hole.

6. The socket according to claim 5, wherein the second engaging portion is formed so as to have a shape of bent double.

7. The socket according to claim 5, wherein the engaging piece is constructed so that:

an upward movement of the lock member is regulated by making an outermost portion of the second engaging portion contact to the lower side outer peripheral edge of the engaging hole, and the engaging piece deforms elastically toward the inside of the engaging hole to thereby release the regulation of the upward movement of the lock member when the force is applied.

8. The socket according to claim 1, wherein a pair of the engaging pieces is provided symmetrically.

9. The socket according to claim 1, further comprising a plurality of the lock members located at a plurality of places, respectively.

10. A socket comprising:

a socket body which accommodates an electrical part and which has an engaging hole;

a contact pin which is inserted into the socket body and which contacts a terminal of the electrical part when the electrical part is accommodated by the socket body;

a locater plate which is located on a lower side of the socket body and is vertically movable, and has an insertion hole through which a lower terminal portion of the contact pin is inserted; and a lock member comprising:

a fixing portion which is fixed by the locater plate, and an engaging piece which is inserted into the engaging hole of the socket body and extends upward from the fixing portion, the engaging piece comprising a first engaging portion formed at an upper end of the engaging piece and engaged with the engaging hole to thereby regulate a downward movement of the locater plate when the locater plate is at a bottom position, and a second engaging portion which is elastically deformable and is formed below the upper end of the engaging piece, and is engaged with the engaging hole by an elastic force of the engaging piece, so that the second engaging portion thereby regulates an upward movement of the locater plate when the locater plate is at the bottom position and releases the regulation of the upward movement when a force larger than a prescribed force is applied to the locater plate.

* * * * *